United States Patent [19]

Kajitani et al.

[11] 4,420,933

[45] Dec. 20, 1983

[54] EXHAUST SYSTEM

[75] Inventors: Ikuo Kajitani, Hanno; Tadayoshi Hayashi, Fujimi; Sakuji Arai, Saitama; Yutaka Hirayama, Kawagoe, all of Japan

[73] Assignee: Honda Giken Kogyo Kabushiki Kaisha, Tokyo, Japan

[21] Appl. No.: 382,292

[22] Filed: May 26, 1982

[30] Foreign Application Priority Data

Jun. 12, 1981 [JP] Japan ..... 56-85555[U]

[51] Int. Cl.[3] ..... F01N 3/28; F01N 7/06

[52] U.S. Cl. ..... 60/302; 60/299; 60/313; 60/323

[58] Field of Search ..... 60/302, 299, 313, 323

[56] References Cited

U.S. PATENT DOCUMENTS

| | | | |
|---|---|---|---|
| 3,935,705 | 2/1976 | Hergoualch | 60/302 |
| 4,002,433 | 1/1977 | Oser | 60/299 |
| 4,117,672 | 10/1978 | Yamazaki | 60/323 |
| 4,151,716 | 5/1979 | Sakurai | 60/323 |
| 4,151,717 | 5/1979 | Katsumoto | 60/302 |
| 4,261,170 | 4/1981 | Suzuki | 60/302 |

*Primary Examiner*—Douglas Hart

*Attorney, Agent, or Firm*—Lyon & Lyon

[57] ABSTRACT

A system for collecting and catalytically cleaning exhaust gases from an engine which is particularly suited for an arrangement wherein the catalyst is in close proximity to the exhaust ports of the engine. Exhaust pipes are employed having common walls extending longitudinally therethrough to separate and convey exhaust gases from two separate cylinders to a common manifold. The manifold is arranged to provide a mixing of the exhaust from a plurality of cylinders and to direct that homogeneous flow to the catalyst. A restriction is provided at the outlet of the manifold chamber and before an expansion chamber into the catalyst. This outlet and the expansion chamber are designed to provide maximum efficiency in distribution of gases to the catalyst and also provide minimum gas flow disruption and back pressure.

10 Claims, 2 Drawing Figures

EXHAUST SYSTEM

BACKGROUND OF THE INVENTION

The field of the present invention is directed to exhaust systems for internal combustion engines and the equipment thereof.

Exhaust systems for internal combustion engines have recently required the addition of catalytic converters for many applications, particularly automobiles. The employment of such converters has resulted in increased requirements on the exhaust system to properly condition the exhaust prior to introduction to the converter. Of particular import is the maintenance of substantial heat in the exhaust gases such that effective conversion of polutants can be undertaken in the converter. Additionally, exhaust gas homogeneity is important to evenly distribute pollutants and gas flow through the catalyst. The even distribution of flow results in a minimum of back pressure. The even distribution of pollutants prevents hot spots resulting from a concentration of reacting pollutants, overloading of the catalyst preventing adequate conversion, and eventual blinding of the catalyst prematurely.

The principal solution to insuring homogeneity in both flow and mixture is to position the catalyst at some distance from the engine. However, additional attention must be directed to the design to insure maintenance of the appropriate temperature in the exhaust gases in such devices. Alternately, the catalyst may be placed close to the engine to insure proper heat maintenance. However, the proximity of the catalyst to the several exhaust passages from a multicylinder engine creates problems with gas flow and pollutant homogeneity to the catalyst and can also result in contamination of the engine by catalyst or catalytic converter particles drawn into the engine due to pulsation of the exhaust gases. Thus, in the situation where the catalytic converter is best placed close to the engine, a need exists for creating gas flow homogeneity, protection against catalytic particle injection into the engine and adequate heat maintenance.

SUMMARY OF THE INVENTION

The present invention is directed to an improved exhaust system and the manifold therefor. To this end, the invention contemplates the use of exhaust passages to reduce heat loss by advantageous positioning of the passages. Exhaust passages are employed in the preferred embodiment having a common wall between pairs of such passages. Furthermore, a manifold chamber collects and mixes gases from the plurality of exhaust passages and evenly distributes the resulting homogeneous mixture through a manifold chamber outlet toward a catalyst.

In one aspect of the present invention, the outlet forms a discontinuity in the oblately spheroidal inner surface of the manifold chamber to insure that the exhaust gases passing therethrough will be adequately mixed and distributed. To prevent unnecessary back pressure, the outlet from the manifold chamber may employ a cross-sectional area equal to or greater than that of each exhaust passage directed to the manifold chamber. Furthermore, an expansion chamber may be provided between the manifold chamber outlet and the catalyst. It has been found advantageous to make the expansion chamber at least as large as the manifold chamber before it. The manifold chamber outlet thereby forms a restriction between the manifold chamber and the expansion chamber.

The employment of the common wall between exhaust passages has been found beneficial in the appropriate maintenance of exhaust heat. The manifold chamber and its outlet have been configured to provide homogeneity to the flow of exhaust therethrough and the expansion chamber has been found to also cooperate in the appropriate distribution of exhaust to the catalyst. The overall arrangement is understood to restrict the back flow of particles due to gas pulsation in the exhaust system. Thus, the difficulties discussed above which are often associated with placement of the catalyst in close proximity of the engine can be overcome.

Accordingly, it is a primary object of the present invention to provide an improved exhaust system.

It is another object of the present invention to provide an improved exhaust manifold for a multicylinder engine.

Other and further objects and advantages will appear hereinafter.

DETAILED DESCRIPTION OF THE PREFERRED EMBODIMENT

Figure 1:
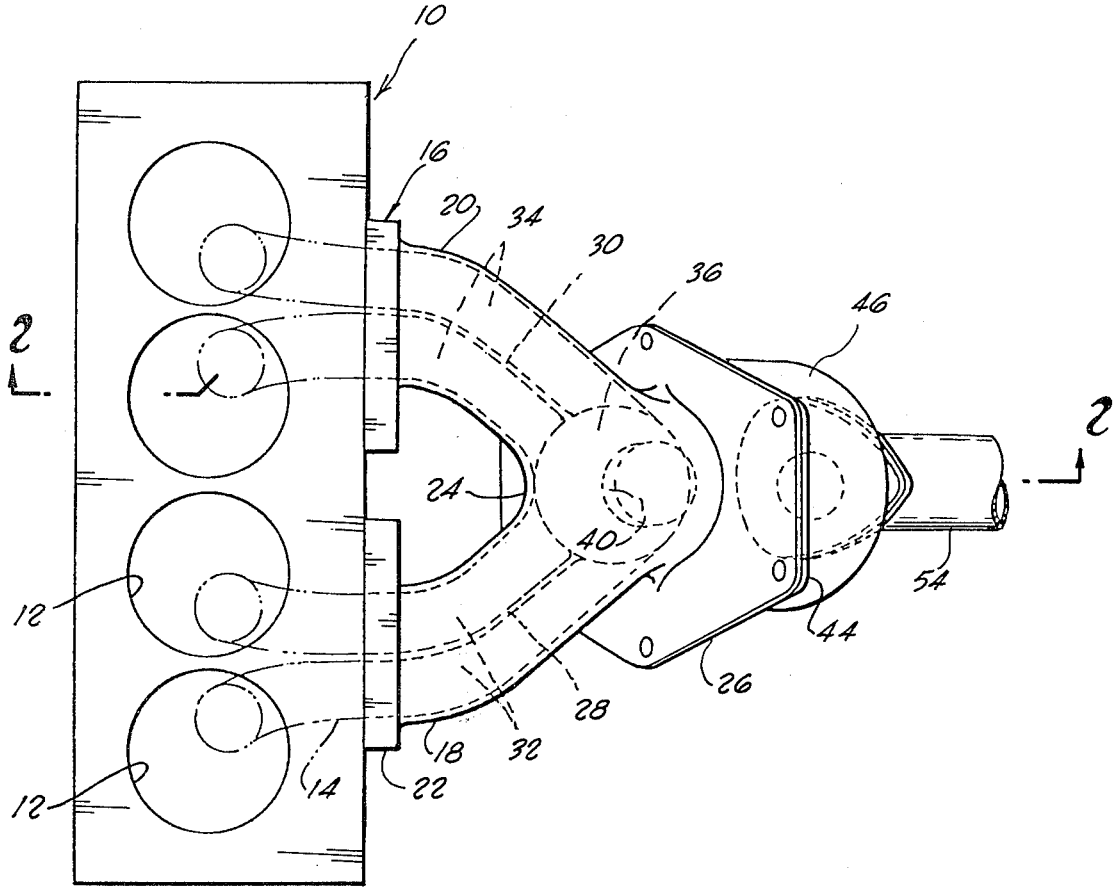
FIG. 1 is a plan view of an exhaust system of the present invention in combination with a multicylinder engine.

Turning in detail to the drawings, an engine 10 is schematically shown as including four cylinders 12. From each of these cylinders 12 an exhaust port 14 extends to the side wall of the engine. At the side wall of the engine, the exhaust ports 14 are in communication with an exhaust manifold, generally designated 16. The exhaust manifold 16 includes two exhaust pipes 18 and 20 which are directed from attachment flanges 22 adjacent the engine 10 to a common manifold housing 24. Each exhaust pipe 18 and 20 is integrally formed with the manifold housing 24 in this preferred embodiment. Associated with the manifold 16 adjacent the manifold housing 24 is an outlet attachment flange 26.

Internally of each exhaust pipe 18 and 20 there is a common wall 28 and 30. This common wall extends lengthwise through each pipe to divide each pipe into two exhaust passages 32 and 34. The placement of the common walls 28 and 30 divides the exhaust gases in each pipe exhausted from each cylinder. Because of the juxtaposition of exhaust passages, less exhaust pipe surface area is exposed to radiate heat from the gases.

Figure 2:
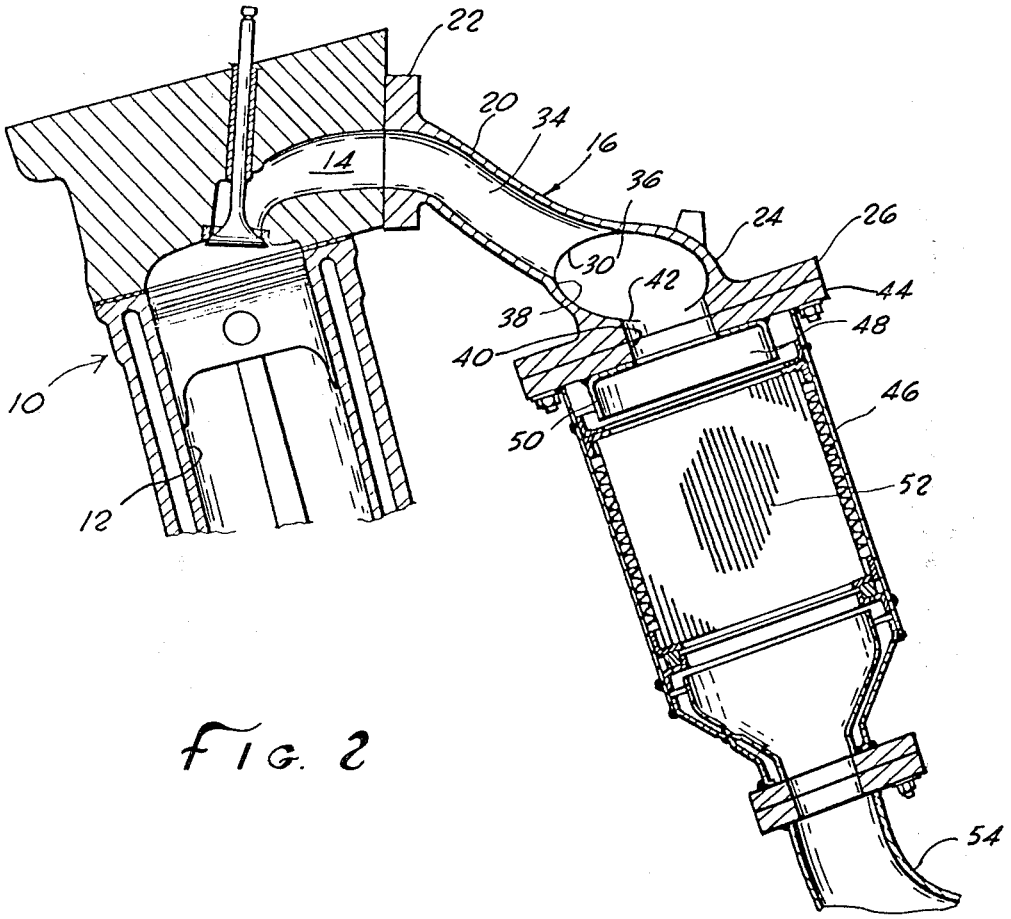
FIG. 2 is a cross-sectional elevation taken along line 2—2 of FIG. 1.

In communication with each of the exhaust passages 32 and 34 is a manifold chamber 36 defined within the manifold housing 24. This manifold chamber 36 is roughly an oblate spheroid. The walls, with the exception of the common walls 28 and 30, of the exhaust pipes 18 and 20 intersect in substantial continuity with the inner oblately spheriodal surface of the manifold chamber 36. Some slight discontinuity may exist if the overall effect to distribute gasses throughout the chamber is realized. One such transition is illustrated in FIG. 2 at 38. By contrast, a manifold chamber outlet 40 extending through the mounting flange 26 intersects the oblate spheroid surface of the manifold chamber at a sharp discontinuity at 42. In this way, flow through the exhaust passages 32 and 34 is directed to the entire manifold chamber 36. At the same time, this flow is generally constrained from flowing in an equally smooth pattern through the outlet 40 from the manifold chamber 36. Thus, mixing is induced and flow homogeneity results.

The manifold chamber outlet 40 is defined by a hole through both the mounting flange 26 of the manifold 16 and the mounting flange 44 of an associated catalyst carrier 46. Below the mounting flange 44 in the catalyst carrier 46 is an expansion chamber 48. An inner casing 50 may be provided in the expansion chamber 48. This prevents some heat transfer to the wall of the catalyst carrier 46. Below the expansion chamber 48 is the catalyst 52 contained within the catalyst carrier 46. The catalyst carrier 46 is connected in a conventional manner to a common exhaust pipe 54.

To further enhance flow through the exhaust system, it is preferred that the manifold chamber outlet 40 have a cross-sectional area which is equal to or greater than that of each exhaust passage 32 and 34. It is also preferred that the expansion chamber 48 is equal to or larger than the volume of the manifold chamber 36.

Thus, an improved exhaust system and manifold therefore are disclosed which are particularly suited to the placement of a catalyst comparatively close to the exhaust ports of an engine. While embodiments and applications of this application have been shown and described, it would be apparent to those skilled in the art that many more modifications are possible without departing from the inventive concepts herein. The invention, therefore, is not to be restricted except by the spirit of the appended claims.

What is claimed is:

1. An exhaust system in a multicylinder engine, having a plurality of elongate exhaust passages in communication with respectively cylinders in the multicylinder engine, a manifold chamber in communication with said elongate exhaust passages and a catalyst in communication with said manifold chamber, wherein the improvement comprises a common wall between two adjacent exhaust passages of said plurality of elongate exhaust passages, said manifold chamber having an inner oblately spheroidal surface, and a restricted outlet from said manifold chamber in communication with said catalyst.

2. The exhaust system of claim 1 further including an expansion chamber between said outlet from said manifold chamber and said catalyst.

3. The exhaust system of claim 2 wherein said expansion chamber has a volume at least equal to said manifold chamber.

4. The exhaust system of claim 1 wherein said outlet from said manifold chamber has a cross-sectional area at least as large as that of each said elongate exhaust passage.

5. The exhaust system of claim 1 wherein said outlet from said manifold chamber includes a peripheral surface which is discontinuous with said inner oblately spheroidal surface of said manifold chamber at the intersection thereof, the inner surfaces of said exhaust passages being substantially continuous with said inner oblately spheroidal surface of said manifold chamber.

6. The exhaust system of claim 2 wherein said manifold chamber, said outlet from said manifold chamber, said expansion chamber and said catalyst are arranged sequentially in a straight path.

7. The exhaust system of claims 1, 2, 3, 4, 5, or 6 wherein said plurality of elongate exhaust passages include four exhaust passages and two said common walls.

8. An exhaust manifold for a bank of four cylinders in an internal combustion engine, comprising first and second exhaust pipes, each said pipe having a wall extending lengthwise therethrough and defining two exhaust passages in each said exhaust pipe and a manifold chamber being in communication with each said exhaust passage and having an inner oblately spheroidal surface and an outlet from said manifold chamber, said oblately spheroidal surface being discontinuous at the periphery of said outlet.

9. The exhaust manifold of claim 8 wherein the inner peripheral surface of each pipe extends in substantial continuity of the inner oblately spheroidal surface of said manifold chamber.

10. The exhaust manifold of claim 8 wherein said outlet has a cross-sectional area at least as large as that of each said exhaust passage.

* * * * *

UNITED STATES PATENT AND TRADEMARK OFFICE

CERTIFICATE OF CORRECTION

PATENT NO. : 4,420,933

DATED : Dec. 20, 1983

INVENTOR(S) : IKUO KAJITANI, TADAYOSHI HAYASHI, SAKUJI ARAI & YUTAKA HIRAYAMA

It is certified that error appears in the above—identified patent and that said Letters Patent is hereby corrected as shown below:

In Claim 1, line 3, delete "respectively" and insert therefor -- respective --.

Signed and Sealed this

Sixth Day of November 1984

[SEAL]

*Attest:*

GERALD J. MOSSINGHOFF

*Attesting Officer*

*Commissioner of Patents and Trademarks*